US011788243B2

(12) United States Patent
Windgassen et al.

(10) Patent No.: US 11,788,243 B2
(45) Date of Patent: Oct. 17, 2023

(54) MOUNTING BRACKET AND METHODS FOR MOUNTING A PUSH ARM TO A WING PLOW

(71) Applicant: Monroe Truck Equipment, Inc., Monroe, WI (US)

(72) Inventors: James Windgassen, Monroe, WI (US); Andrew Holverson, Monroe, WI (US)

(73) Assignee: Monroe Truck Equipment, Inc., Monroe, WI (US)

( * ) Notice: Subject to any disclaimer, the term of this patent is extended or adjusted under 35 U.S.C. 154(b) by 399 days.

(21) Appl. No.: 17/196,162

(22) Filed: Mar. 9, 2021

(65) Prior Publication Data

US 2022/0290389 A1 Sep. 15, 2022

(51) Int. Cl.
*E01H 5/06* (2006.01)

(52) U.S. Cl.
CPC ..... *E01H 5/067* (2013.01)

(58) Field of Classification Search
CPC ..... E01H 5/067
See application file for complete search history.

(56) References Cited

U.S. PATENT DOCUMENTS 2,231,268 A * 2/1941 Hoare ..... E01H 5/06 37/272
4,357,766 A 11/1982 Croteau et al.
4,744,159 A * 5/1988 Houle ..... E01H 5/067 37/231
5,031,343 A * 7/1991 Houle ..... E01H 5/067 37/231
5,048,207 A * 9/1991 Verseef ..... E01H 5/065 37/197
6,247,254 B1 * 6/2001 Wessman ..... E01H 5/067 37/248
6,523,620 B1 * 2/2003 Burson ..... E01H 5/066 172/815
7,743,536 B2 * 6/2010 Evans ..... E01H 5/06 37/231
9,353,495 B2 * 5/2016 Becicka ..... E01H 5/061
10,196,790 B1 * 2/2019 Null ..... E01H 5/067
2005/0193602 A1 * 9/2005 Osgood ..... E02F 3/40 37/411
2007/0193074 A1 * 8/2007 Savard ..... E01H 5/067 37/274
2013/0160333 A1 * 6/2013 Becicka ..... E01H 5/062 37/231
2016/0273176 A1 9/2016 Becicka et al.
2020/0354910 A1 * 11/2020 Niemela ..... E01H 5/068
2022/0290389 A1 * 9/2022 Windgassen ..... E01H 5/067

* cited by examiner

*Primary Examiner* — Jamie L McGowan
(74) *Attorney, Agent, or Firm* — Quarles & Brady LLP

(57) ABSTRACT

A mounting bracket and method for mounting a push arm to a wing plow. The mounting bracket can include a clevis portion, a backstop, and a mounting flange. The mounting flange can have a first mounting flange hole, a second mounting flange hole, and a third mounting flange hole. The mounting bracket can be configured to be mountable to the wing plow in a first orientation using the first and second mounting flange holes and can be mountable to the plow in a second orientation, using the second and third mounting hole. The second orientation can be rotationally offset from the first orientation about at least one rotational axis.

20 Claims, 6 Drawing Sheets

MOUNTING BRACKET AND METHODS FOR MOUNTING A PUSH ARM TO A WING PLOW

BACKGROUND

In many applications, wing plows can be supported at extended positions and orientations relative to a plow truck frame. Push arms are generally coupled to the wing plow and the plow truck frame to support the wing plow against the force exerted along the wing plow during plowing operations.

SUMMARY

Some embodiments of the invention provide a mounting bracket for mounting a push arm to a wing plow. The mounting bracket can include a clevis portion with parallel prongs and a cross-member extending between the prongs. The mounting bracket can further include a backstop with a first backstop section at least partially defined by the cross-member and a second backstop section extending from the first backstop section at an acute angle relative to the prongs. A mounting flange can extend in a mounting flange plane, perpendicular from and along the backstop. The mounting flange can have a first mounting flange hole, a second mounting flange hole, and a third mounting flange hole. The mounting bracket can be configured to be mountable to the wing plow in a first orientation using the first and second mounting flange holes and can be mountable to the plow in a second orientation, using the second and third mounting hole. The second orientation can be rotationally offset from the first orientation about at least one rotational axis.

Some embodiments can provide a mounting bracket for alternatively mounting a push arm to a wing plow in a first orientation or a second orientation angularly offset relative from the first orientation. The mounting bracket can include a backstop with a first section and a second section extending at a 30 degree angle from the from the first section. A set of prongs can extend from the backstop in a first direction. A mounting flange can extend from the backstop in a second direction opposite the first direction. The mounting flange can have a plurality of mounting flange holes, a first set of which can be configured to mount the mounting bracket to the wing plow in the first orientation and a second set of which can be configured to mount the mounting bracket to the wing plow in the second orientation.

Some embodiments can provide a method for switching a mounting bracket for mounting a push arm to a wing plow between a first orientation and a second orientation. The mounting bracket can have a mounting flange with a first mounting flange hole, a second mounting flange hole, and a third mounting flange hole. With the mounting bracket attached to the wing plow in the first orientation with a first fastener installed in the first mounting flange hole and a second fastener installed in the second mounting flange hole, the method can include removing the first fastener from the first mounting flange hole and loosening the second fastener within the second mounting flange hole; rotating the mounting bracket relative to the wing plow about the second fastener; and installing the first fastener within the third mounting flange hole to secure the mounting bracket to the wing plow in the second orientation.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
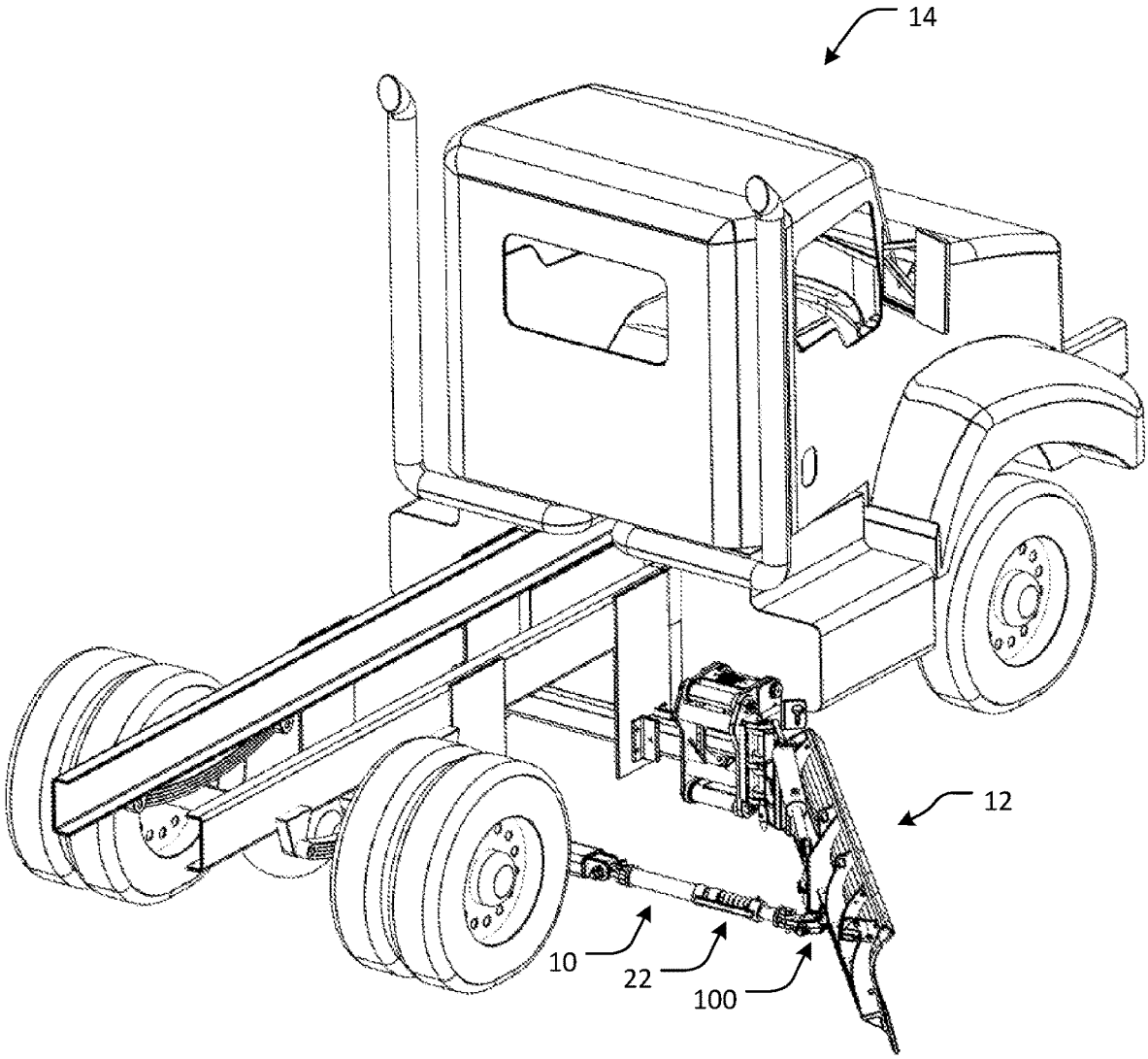
FIG. 1 is a rear top left perspective view of a plow truck with a wing plow with a mounting bracket according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also as used herein, unless otherwise specified or limited, directional terms are presented only with regard to the particular embodiment and perspective described. For example, reference to features or directions as "horizontal," "vertical," "front," "rear," "left," "right," "upper," "lower," and so on are generally made with reference to a particular figure or example and are not necessarily indicative of an absolute orientation or direction. However, relative directional terms for a particular embodiment may generally apply to alternative orientations of that embodiment. For example, "front" and "rear" directions or features (or "right" and "left" directions or features, and so on) may be generally understood to indicate relatively opposite directions or features for a particular embodiment, regardless of the absolute orientation of the embodiment (or relative orientation relative to environmental structures). "Lateral" and derivatives thereof generally indicate directions that are generally perpendicular to a vertical direction for a relevant reference frame.

Also as used herein, ordinal numbers are used for convenience of presentation only and are generally presented in an order that corresponds to the order in which particular features are introduced in the relevant discussion. Accordingly, for example, a "first" feature may not necessarily have any required structural or sequential relationship to a "second" feature, and so on. Further, similar features may be referred to in different portions of the discussion by different ordinal numbers. For example, a particular feature may be referred to in some discussion as a "first" feature, while a similar or substantially identical feature may be referred to in other discussion as a "third" feature, and so on.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

In some contexts, it may be useful to be able to mount a push arm at different angles relative to a wing plow because not all plow trucks have a mount for the push arm located in the same relative area on the plow truck frame, and the angle from which the push arm extends from the plow truck frame can vary. Further, it may be useful to be able to switch the angle of the push arm relative to the wing plow to accommodate different plow trucks without having to remove and replace the mounting bracket that couples the push arm to the wing plow. Embodiments of the invention can be useful for this purpose, and others. For example, embodiments of the invention can be used to couple a push arm to a wing plow in at least two orientations. Some embodiments of the invention can include a mounting bracket that is mountable to a wing plow and selectively switchable between alternative mounting orientations, including without needing to fully remove the mounting bracket from the wing plow. As another example, a mounting bracket according to other embodiments can be secured to a wing plow a plurality of fasteners, wherein one of the fasteners is used to secure the mounting bracket in both orientations.

In some embodiments, a mounting bracket can include a mounting flange that are configured to permit mounting a push arm to a wing plow in two orientations. The mounting flange can have a plurality of mounting flange holes that are alignable with mounting holes on the wing plow and through which a fastener is receivable. At least two of the mounting flange holes can be aligned along a first line and at least two of the mounting flange holes can be aligned along a second line, which is disposed at an angle from the first line. In some embodiments, one of the mounting flange holes can be used for both mounting orientations. In some embodiments, the fastener received within the shared mounting flange hole can be used as a pivot point to switch the mounting bracket between orientations.

In some embodiments, a mounting bracket can have a backstop that abuts the wing plow to allow the force exerted upon the plow during operation to be transferred to the push arm. In some embodiments, the backstop can be configured to abut the wing plow when the mounting bracket is mounted to the wing plow in more than orientation. In some embodiments, the backstop can extend in parallel to the mounting flange holes. In some embodiments, the backstop can have a first backstop section that extends parallel to the first line of mounting flange holes and a second backstop section that extends parallel to the second line of mounting flange holes.

In some contexts, it may be useful to provide a mounting bracket that allows attachment of a push arm to a wing plow in in different orientations and also capable of mounting push arms to wing plows mounted on either side of the truck. In some embodiments, the mounting bracket is symmetrical along at least one axis to enable the mounting bracket to be mountable to a wing plow on a passenger side of the truck and flipped over and be mountable to a wing plow on a driver side of the truck.

In some conventional arrangements, mounting brackets for mounting a push arm to a wing plow are configured to allow the attachment of the wing plow in only one orientation. Thus, two different mounting brackets are needed if mounting a push arm in two orientations is desired. To switch push arm orientations, a user is required to completely remove a first mounting bracket for a first mounting orientation and install a second mounting bracket for a second mounting orientation. The required removal and installation of separate, specialized mounting brackets is time consuming and requires storage of the unused mounting bracket.

Some embodiments of the invention can address this issue, or others. For example, some embodiments of the invention are presented below in the context of a convertible mounting bracket for mounting a push arm to a wing plow, wherein the mounting brackets have mounting features that can accommodate mounting to a push arm to a wing plow in at least two orientations. Generally, the principles disclosed herein can be used with any variety of side-mounted plow, including, but not limited to, wing plows, and can be used to secure any variety of structural or attachment components to the side-mounted plow.

With regard to construction, various embodiments can be readily formed from a variety of known manufacturing techniques, including casting. For example, some embodiments, including the embodiment illustrated in the FIGS., can be cast as one piece. In other embodiments, multiple pieces can be cast and joined together through methods such as welding.

FIG. 1 illustrates an embodiment of a mounting bracket 100 configured for coupling a push arm 10 to a wing plow 12 attached to a truck 14. Shown here, the push arm 10 extends perpendicular to the length of the truck 14, although other orientations are possible. As described further below, the mounting bracket 100 is configured to be mounted in either a first orientation (shown in FIGS. 4 through 6) or a second orientation (shown in FIGS. 7 through 9) depending on the arrangement of the push arm 10 as it is mounted to and extends from the truck 14. Further, although the discussion herein is tailored to an application in which the mounting bracket 100 is configured to be coupled to a wing plow 12 for conciseness and clarity, it should be noted that the mounting bracket 100 is also configured to be coupled to other types of plows (e.g., a patrol wing) and plows with horizontal mounting flanges like the plow flange 20 provided on the wing plow 12 described below. Additionally, in some applications, more than one mounting bracket 100 can be used to couple more than one push arm to a plow.

As shown in FIG. 1, because the push arm 10 extends perpendicularly from the truck 14, the coupling of the push arm 10 to the wing plow 12 occurs at an angle less than 90 degrees (e.g., 60 degrees). To achieve such a mounting angle, the mounting bracket 100 is mounted to the wing plow 12 in the second orientation. Alternatively, if a push arm extends outward and angled toward the front of the truck 14 at an angle less than 90 degrees (e.g., 30 degrees), the mounting bracket 100 is mounted in the first orientation for coupling the push arm 10 perpendicular to the length of the wing plow 12. Although these particular angles may be useful for a variety of wing plow and plow vehicle designs, other embodiments according to the principles disclosed herein may be configured to provide other alternative mounting angles.

Figure 2:
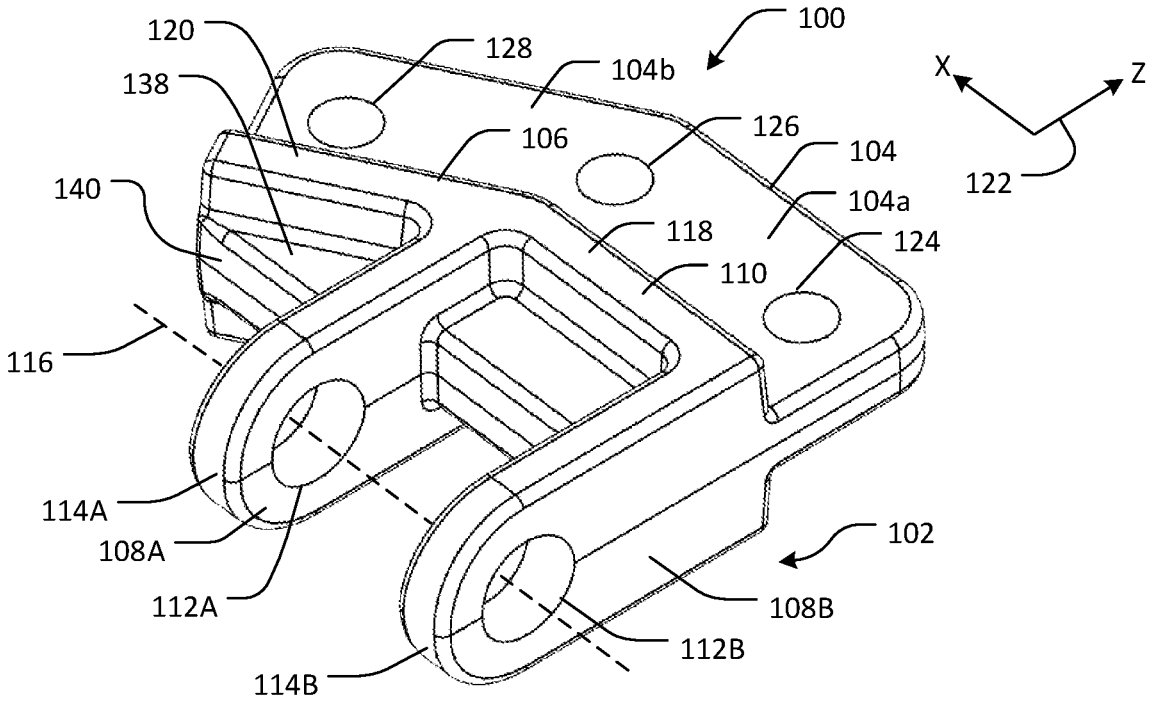
FIG. 2 is a front top right perspective view of the mounting bracket of FIG. 1.
Figure 3:
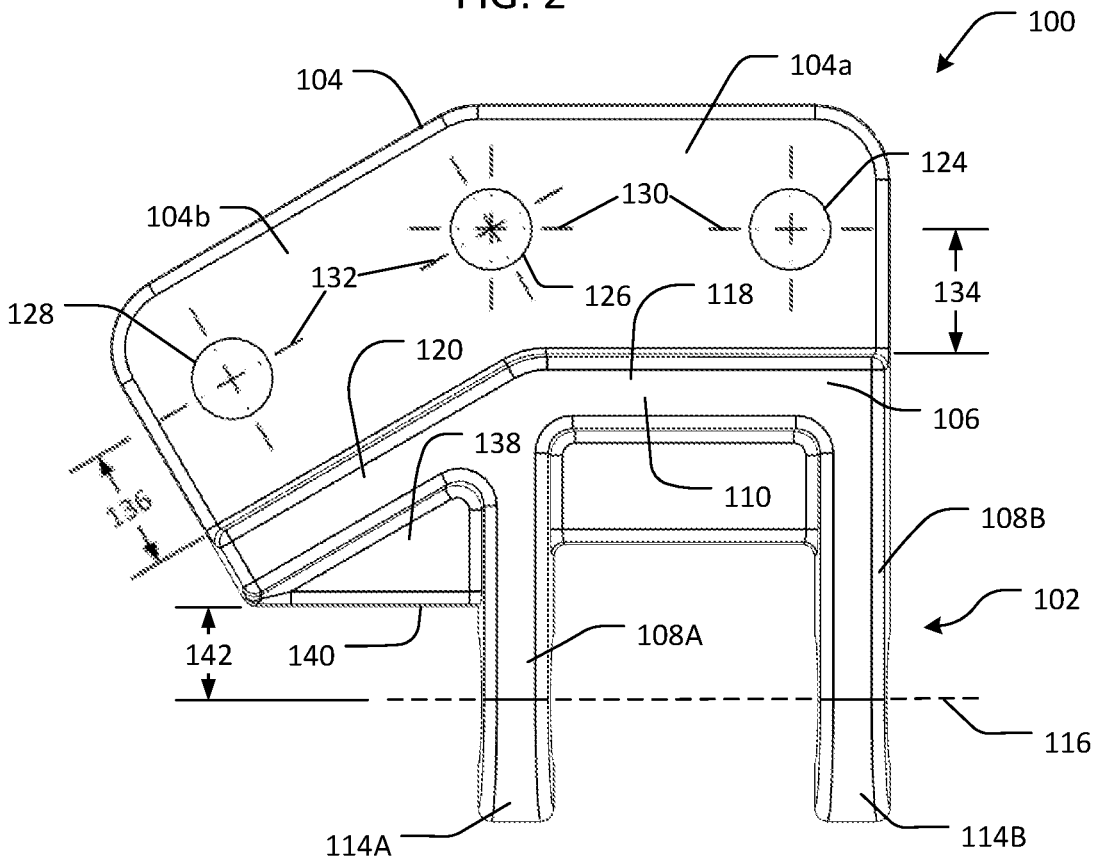
FIG. 3 is a top plan view of the mounting bracket of FIG. 1.
Figure 4:
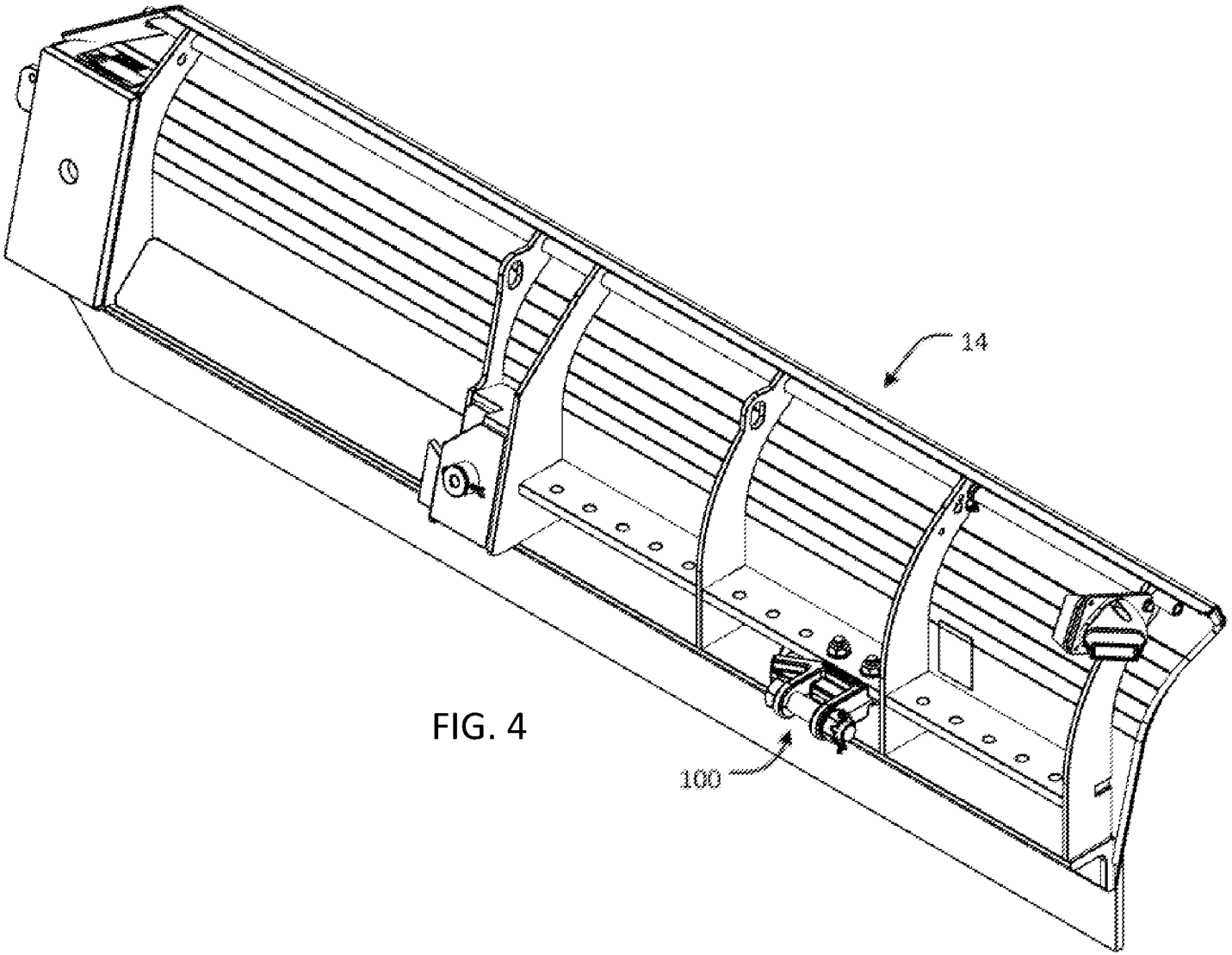
FIG. 4 is a rear top right perspective view of a wing plow with the mounting bracket of FIG. 1 attached thereto in a first orientation according to an embodiment of the invention.
Figure 7:
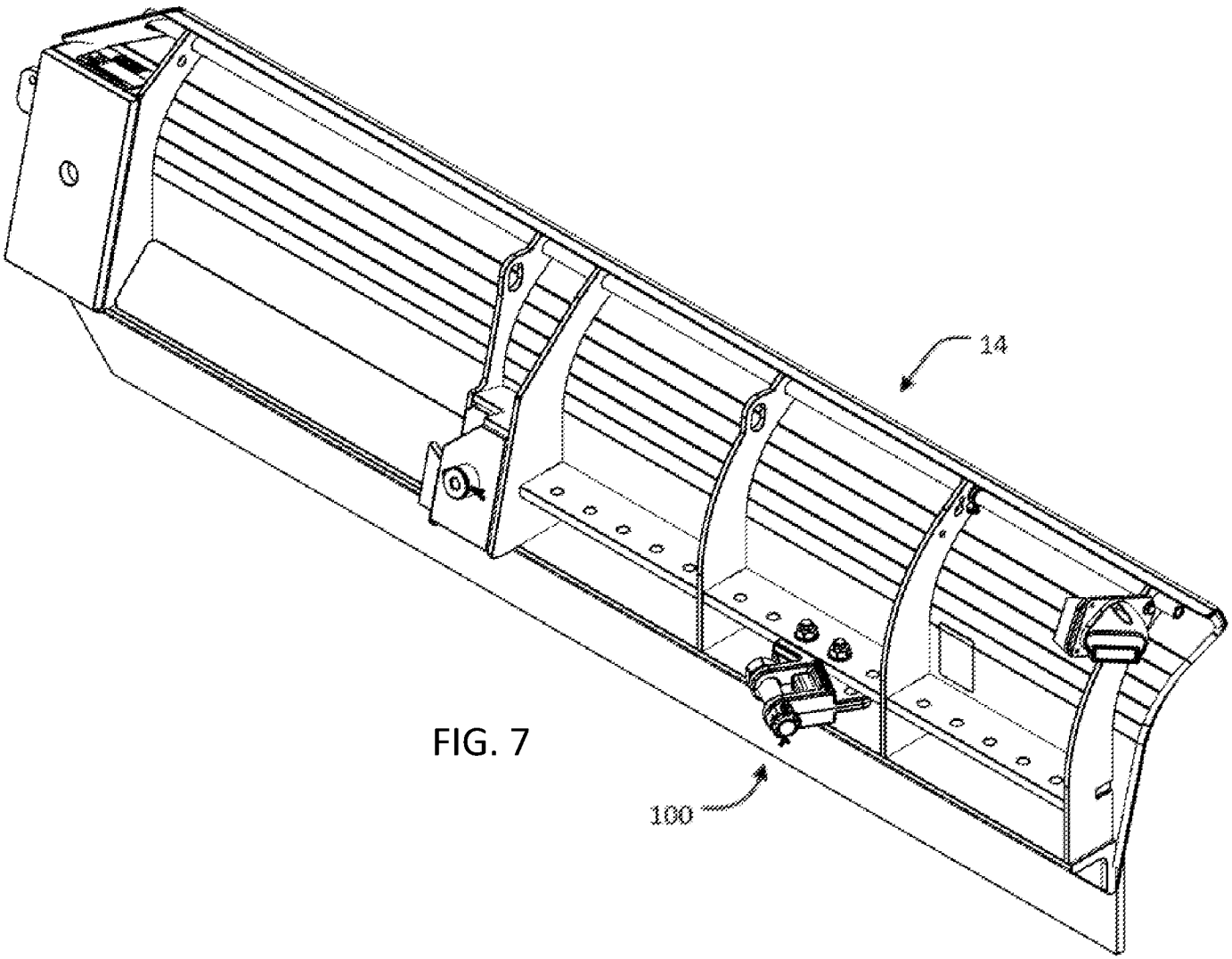
FIG. 7 is a rear top right perspective view of a wing plow with the mounting bracket of FIG. 1 attached thereto in a second orientation according to an embodiment of the invention.

Turning now to FIGS. 2 and 3, in particular, the mounting bracket 100 contains various features for the attachment to the push arm 10 (shown in FIG. 1) and to the wing plow 12 (shown in FIGS. 1, 4, and 7). For example, the mounting bracket 100 has a clevis portion 102, a mounting flange 104, and a backstop 106 between and separating the clevis portion 102 and the mounting flange 104. As shown, the clevis portion 102, the mounting flange 104, and the backstop 106 are integrally joined to form the mounting bracket 100, however, it is contemplated that the mounting bracket 100 can be formed by joining (e.g., by welding) these features, if they are provided in more than one piece.

Continuing to look at FIGS. 2 and 3, the clevis portion 102 includes a set of prongs 108 extending in parallel perpendicularly from a cross-member 110. In the example embodiment shown, the clevis portion 102 has two prongs, designated with an "A" or "B" following the part number 108. Although other configurations are possible, the prongs 108 are generally similar to each other. Accordingly, unless a particular prong is specifically being described, the set of prongs will be discussed below using only the part number 108. The same system applies to other features of the prongs 108 as well. Although the configuration of the prongs 108 may be particularly suitable for a strong, robust, and easily manageable connection to a push arm, a variety of other attachment systems can be used in other embodiments.

In the illustrated embodiment, each of the prongs 108 has a prong hole 112 at a distal end 114 thereof. The prong holes 112 are aligned along a prong hole axis 116 that extends through a center of each of the prongs 108. The prong holes 112 are configured to receive a pin there-through to couple the push arm 10 to the mounting bracket 100. In some embodiments, the pin can be a bolt 16 (shown in FIGS. 4 through 9).

The backstop 106 is also visible in FIGS. 2 and 3. The backstop 106 has a first backstop section 118 and a second backstop section 120. The first backstop section 118 is at least partially defined by the cross-member 110 of the clevis portion 102, and extends parallel to the prong hole axis 116. The second backstop section 120 extends from the first backstop section 118 at an angle of approximately 60 degrees (shown in FIG. 3) relative to the prong 108A and therefore extends from the first backstop section 118 at an angle of approximately 150 degrees. Although these angles may be particularly conducive to effective attachment in some installations, other angular relationships are also possible.

As shown in FIGS. 5, 6, 8, and 9, the backstop 106 is configured to contact the wing plow 12 when the mounting bracket 100 is installed thereon. For instance, in FIGS. 5 and 6, the first backstop section 118 is shown in contact with a front edge 18 of a plow flange 20 when the mounting bracket 100 is mounted in the first orientation. Further, in FIGS. 8 and 9, the second backstop section 120 is shown in contact with the front edge 18 of the plow flange 20 when the mounting bracket 100 is mounted in the second orientation. The backstop 118 is configured to transfer force exerted on the face of the wing plow 12 during operation to the push arm 10, which has a compression spring section 22 (see FIG. 1) configured to help absorb the force.

Further details of the mounting flange 104 are also shown in FIGS. 2 and 3. The mounting flange 104 extends perpendicularly outward from and along the backstop 106 and along a mounting flange plane 122. In some embodiments, the prong hole axis 116 lies within the mounting flange plane, as may help to improve manufacturability and overall strength of the mounting bracket 100 during use.

Generally, a mounting flange can include an array of holes, some of which can be configured to secure a mounting bracket in a first orientation and some of which can be configured to secure the mounting bracket in a second orientation (e.g., that is rotationally offset from the first orientation about at least one rotational axis). In the embodiment illustrated, the mounting flange 104 has a first mounting flange hole 124, a second mounting flange hole 126, and a third mounting flange hole 128. The mounting flange holes 124, 126, 128 are configured to receive fasteners (e.g., mounting bolts 34 shown in FIGS. 5, 6, 8, and 9) to secure the mounting bracket 100 to the plow flange 20.

Continuing, in the illustrated embodiment, the first and second mounting flange holes 124, 126 are spaced along a first line 130, which is parallel to the first backstop section 118. The first and second mounting flange holes 124, 126 are also laterally spaced from the first backstop section 118 a first distance 134. The second and third mounting flange holes 126, 128 are spaced along a second line 132 parallel to the second backstop section 120. Therefore, the second line 132 is disposed at the same angle from the first line 130 as the second backstop section 120 is relative to the first backstop section 118, approximately 135 degrees. The second and third mounting flange holes 126, 128 are laterally spaced from the second backstop section 120 a second distance 136. In the illustrated example, the first distance 134 is equal to the second distance 136. As further described below, this can help to ensure effective transmission of force to the push arm 10 for each of two mounting configurations of the mounting bracket 100.

Consistent with the discussion above, in some cases a first set of mounting flange holes can be disposed on a first section of a mounting flange, and a second set of mounting flange holes can be disposed on a second section of the mounting flange. For example, for the mounting bracket 100, the first mounting flange hole 124 extends through a first section 104A of the mounting flange 104, which extends along the first backstop section 118, and the third mounting flange hole 128 extends through a second section 104B of the mounting flange 104, which extends along the second backstop section 120. Further, the second mounting flange hole 126 extends through the mounting flange at an intersection of the first and second sections 104A, 104B (i.e., along a reference line that bisects an angle between the first and second backstop sections 118, 120 or along a reference line that extends from the prong 108A through an intersection of the first and second backstop sections 118, 120). As also discussed below, this configuration can provide for effective overall support as well as easy adjustability between different mounting orientations.

Figure 5:
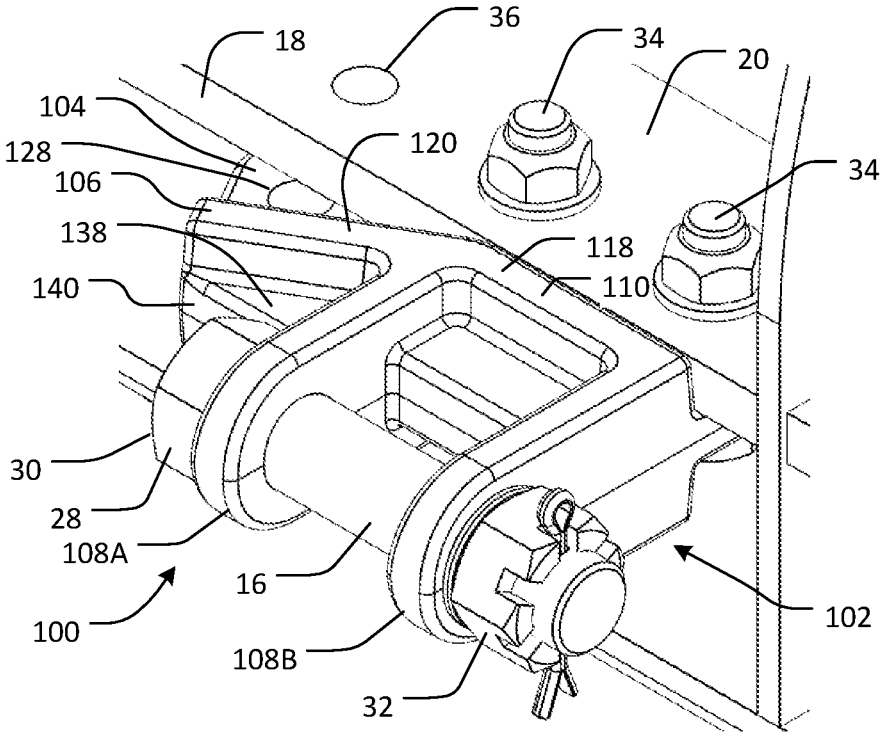
FIG. 5 is a close-up front top right perspective view of the mounting bracket attached to the wing plow shown in FIG. 4.

As additionally shown in FIGS. 2 and 3, the mounting bracket 100 has a gusset 138 extending between the second backstop section 120 and the prong 108A. The gusset 138 increases the structural strength and rigidity of the mounting bracket 100, and can also provide other benefits. For example, in the illustrated embodiment, the gusset 138 has an exposed side 140 that extends in parallel with and is spaced a third distance 142 from the prong hole axis 116. The third distance 142 is a predetermined distance approximately equal to or slightly greater than a bolt-head radius 24 of the bolt 34 (e.g., of a known standard size configured for use in the prong holes 112), which is defined herein as the distance from a bolt axis 26 to a side face 28 of a head 30 of the bolt 34. For example, as shown in FIG. 5, the third distance 142 is equal to the bolt head radius 24. The gusset 138, therefore, can contact the face 28 of the bolt 34 and prevent the bolt 34 from rotating within the prong holes 112. This can be helpful when tightening or loosening a nut 32 to the bolt 34 during the coupling or decoupling of the push arm 10 to the mounting bracket 100 because it prevents the bolt 34 from spinning.

Figure 6:
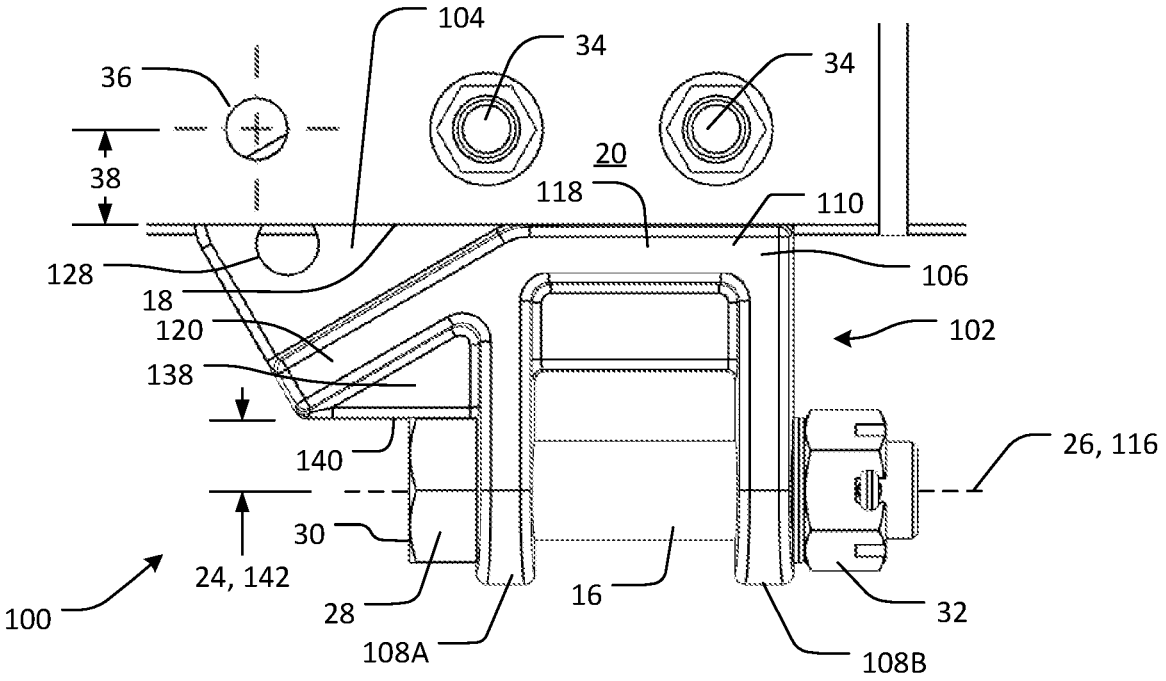
FIG. 6 is a close-up top plan view of the attachment of the mounting bracket to the wing plow shown in FIG. 4.

Turning now to FIGS. 4-6, the mounting bracket 100 is shown mounted to the wing plow 12 in the first orientation. As shown, the mounting flange 104 is positioned below the plow flange 20. It is contemplated, however, that the mounting flange 104 can be positioned on top of the plow flange 20. The plow flange 20 has a plurality of plow mounting holes 36 spaced from an edge 18 of the plow flange 20 by a plow mounting hole distance 38 (see FIG. 6). Further, mounting bolts 34 are placed through the first and second mounting flange holes 124, 126 and two of the plurality of plow mounting holes 36 to secure the mounting bracket 100 to the wing plow 12.

Of note for the illustrated embodiment, the plow mounting hole distance 38 is substantially equal to (e.g., within 10% of) the first distance 134 (see FIG. 3) between the first and second mounting holes 124, 126 and the first backstop section 118. The substantial equality between the distances 38, 134 can result in the first backstop section 118 being positioned in contact with the edge 18 of the plow flange 20, as can help to robustly transfer force from the plow flange 20 to the push arm 10 via the mounting bracket 100.

Figure 8:
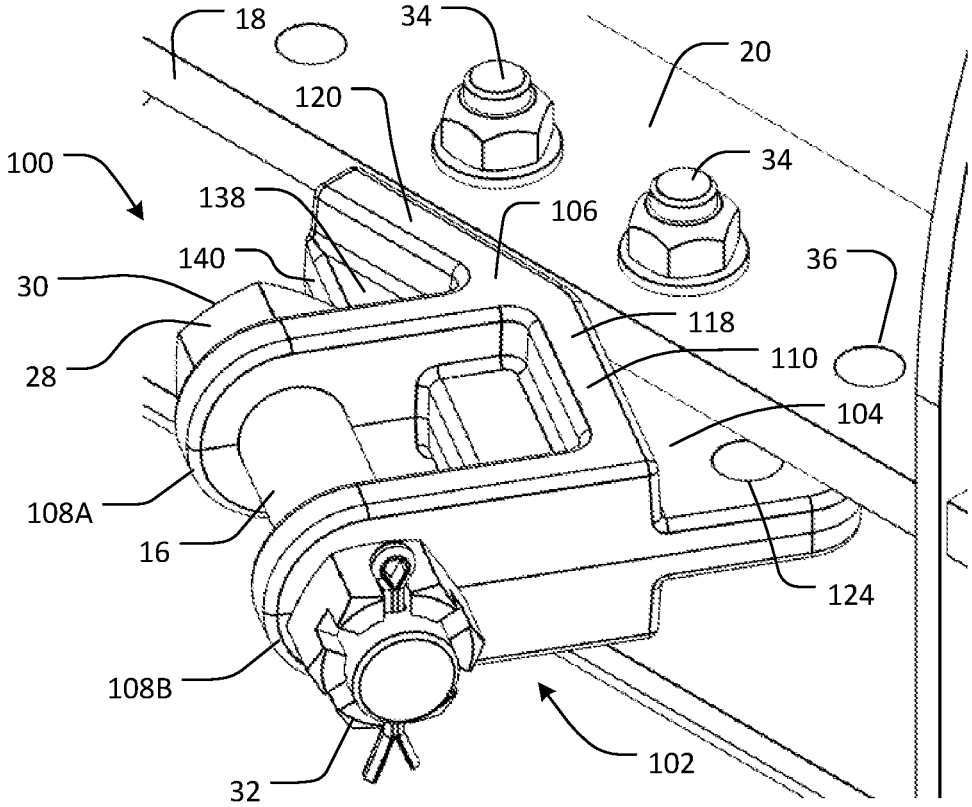
FIG. 8 is a close-up front top right isometric view of the attachment of the mounting bracket to the wing plow shown in FIG. 7.
Figure 9:
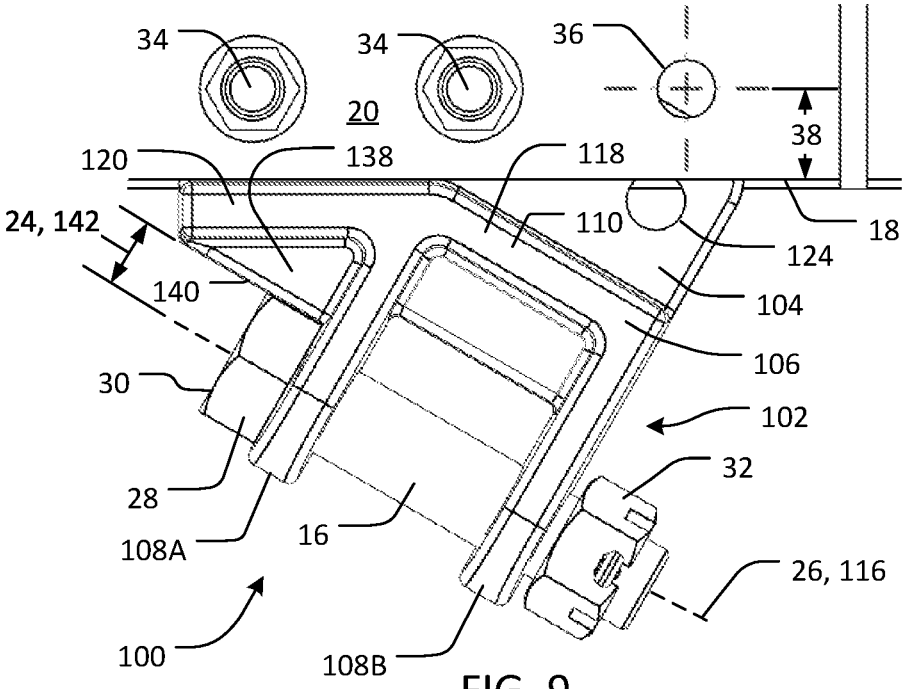
FIG. 9 is a close-up top plan view of the attachment of the mounting bracket to the wing plow shown in FIG. 7.

Looking at FIGS. 7-9, the mounting bracket 100 is shown mounted to the wing plow 12 in the second orientation. The mounting flange 104 is again shown positioned below the plow flange 20, but it is contemplated that the mounting flange 104 can be positioned on top of the plow flange 20. Similarly to the configuration of FIGS. 4-6, but with the mounting bracket 100 in a differently rotated configuration, mounting bolts 34 are placed through the second and third mounting flange holes 126, 128 and two of the plurality of plow mounting holes 36 to secure the mounting bracket 100 to the wing plow 12. As similarly discussed above, because the second distance 136 (see FIG. 3) between the second and third mounting flange holes 126, 128 and the second backstop section 120 is equal to the first distance 134, the second distance 136 is also substantially equal to the plow mounting hole distance 38 (see FIG. 9). The substantial equality between the distances 38, 136 can accordingly position the second backstop section 120 in contact with the front edge 18 of the plow flange 20 for robust transfer of force to the push arm 10.

In some embodiments, it may be possible to move a mounting bracket between two orientations without necessarily removing the mounting bracket from a wing plow. For example, some embodiments can be configured to use a common mounting hole in a mounting flange for each of multiple differently rotated configurations. In this regard, in the illustrated embodiment, the second mounting flange hole 126 is used to mount the mounting bracket 100 to the wing plow 12 in both the first orientation and the second orientation. Correspondingly, switching between the first orientation and the second orientation requires the full removal of one of the mounting bolts 34 and only loosening of the second. For example, the mounting bracket 100 can be rotated about the mounting bolt in the common mounting hole, with the mounting bolt define a rotational axis, to rotationally move the mounting bracket 100 from the first orientation into the second orientation.

In some embodiments, a mounting bracket can be mounted to a wing plow that is attached to either side of a truck (i.e., to the passenger side of the truck 14 as shown in FIG. 1 and to the driver side). For example, the mounting bracket 100 is symmetrical along the mounting flange plane 122 (shown in FIG. 2) and can accordingly be rotated about an axis perpendicular to the prong hole axis 116 and parallel to the mounting flange plane 122 (e.g., the Z-axis as shown in FIG. 2) by 180 degrees to be mountable to a wing plow mounted to the driver side of the truck 14. When mounted to a wing plow on the driver side, the mounting bracket 100 maintains the ability to be mounted to the wing plow in two orientations.

In some implementations, devices or systems disclosed herein can be utilized or installed using methods embodying aspects of the invention. Correspondingly, description herein of particular features or capabilities of a device or system is generally intended to inherently include disclosure of a method of using such features for intended purposes and of implementing such capabilities. Similarly, express discussion of any method of using a particular device or system, unless otherwise indicated or limited, is intended to inherently include disclosure, as embodiments of the invention, of the utilized features and implemented capabilities of such device or system.

For example, with reference to FIGS. 6 and 9, some embodiments can include a method of switching the mounting bracket 100 between a first orientation (FIG. 6) to a second orientation (FIG. 9). The method includes the removal of the mounting bolt 34 from the first mounting flange hole 124 and the loosening of the mounting bolt 34 within the second mounting flange hole 126. The mounting bracket 100 can then be rotated relative to the wing plow 12 about the mounting bolt 34 in the second mounting flange hole 126. Once the third mounting flange hole 128 is aligned with the associated plow mounting hole 36, the previously removed mounting bolt 34 (or a different mounting bolt, for example, if the previously removed mounting bolt 34 is damaged) is installed within the third mounting flange hole 128 to secure the mounting bracket 100 to the wing plow 12 in the second orientation. It should be understood that the method can be performed in reverse for switching the mounting bracket 100 from the second orientation to the first orientation.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

What is claimed is:

1. A mounting bracket for mounting a push arm to a wing plow, the mounting bracket comprising:

a clevis portion with parallel prongs and a cross-member extending between the prongs;

a backstop having a first backstop section at least partially defined by the cross-member and a second backstop section extending from the first backstop section at an acute angle relative to the prongs; and a mounting flange extending in a mounting flange plane, perpendicular from and along the backstop, the mounting flange having a first mounting flange hole, a second mounting flange hole, and a third mounting flange hole;

the mounting bracket configured to be mountable to the wing plow in a first orientation using the first and second mounting flange holes and mountable to the plow in a second orientation, using the second and third mounting holes, the second orientation is rotationally offset from the first orientation about at least one rotational axis.

2. The mounting bracket of claim 1, wherein each prong has a prong hole aligned along a prong axis.

3. The mounting bracket of claim 2, wherein the prong hole axis lies within the mounting flange plane and is parallel with the first backstop section.

4. The mounting bracket of claim 1, wherein the first and second mounting flange holes are spaced along a first line parallel to the first backstop section and the second and third mounting flange holes are spaced along a second line parallel to the second backstop section.

5. The mounting bracket of claim 1, wherein the first mounting flange hole is located in a first section of the mounting flange, which extends along the first backstop section, the third mounting flange hole is located in a second section of the mounting flange, which extends along the second backstop section, and the second mounting flange hole is located on the mounting flange at an intersection of the first and second sections.

6. The mounting bracket of claim 1, further comprising a gusset extending between the second backstop section and the clevis portion.

7. The mounting bracket of claim 6, wherein an exposed side of the gusset extends parallel to and is spaced from the prong hole axis a predetermined distance, the gusset being thereby configured to prevent rotation of a bolt received through the prong holes.

8. The mounting bracket of claim 1, wherein the mounting bracket is configured to be mounted to a plow flange on the wing plow, the plow flange having a front edge and plow mounting holes;

wherein the first and second mounting flange holes are laterally spaced from the first backstop section a first distance, and the second and third mounting flange holes are laterally spaced from the second backstop section a second distance, the first distance being equal to the second distance;

wherein the first and second distances are equal to a plow mounting hole distance between the front edge of the plow flange and the plow mounting holes; and whereby, the first backstop section is configured to contact the front edge when the mounting bracket is mounted in the first configuration and the second backstop section is configured to contact the front edge when the mounting bracket is mounted in the second configuration.

9. The mounting bracket of claim 1, wherein the clevis portion is integrally formed with the backstop and the mounting flange.

10. The mounting bracket of claim 1, wherein the mounting bracket is symmetrical about the mounting flange plane.

11. A mounting bracket for alternatively mounting a push arm to a wing plow in a first orientation or a second orientation angularly offset relative from the first orientation, the mounting bracket comprising:

a backstop having a first section and a second section extending at a 30 degree angle from the from the first section;

a set of prongs extending from the backstop in a first direction;

a mounting flange extending from the backstop in a second direction opposite the first direction, the mounting flange having a plurality of mounting flange holes, a first set of which are configured to mount the mounting bracket to the wing plow in the first orientation and a second set of which are configured to mount the mounting bracket to the wing plow in the second orientation.

12. The mounting bracket of claim 11, wherein the first set of mounting flange holes and the second set of mounting flange holes share at least of one of the mounting flange holes.

13. The mounting bracket of claim 11, wherein the first section of the backstop is configured to contact the wing plow when the mounting bracket is mounted in the first orientation and the second section of the backstop is configured to contact the wing plow when the mounting bracket is mounted in the second orientation.

14. The mounting bracket of claim 11, wherein each of the prongs has a prong hole configured to receive a pin therethrough to secure the push arm to the mounting bracket.

15. The mounting bracket of claim 14, wherein the prong holes are aligned along a prong hole axis, the prong hole axis being parallel with the first section of the backstop.

16. The mounting bracket of claim 11, further comprising a gusset extending between the second backstop section and the adjacent prong of the set of prongs.

17. The mounting bracket of claim 16, wherein the gusset is configured to prevent rotation of a bolt received through the prong holes.

18. The mounting bracket of claim 11, wherein the backstop is integrally formed with the set of prongs and the mounting flange.

19. The mounting bracket of claim 11, wherein the mounting flange extends in a mounting flange plane and the mounting bracket is symmetrical about the mounting flange plane.

20. A method for switching a mounting bracket for mounting a push arm to a wing plow between a first orientation and a second orientation, the mounting bracket having a clevis portion with parallel prongs and a cross-member extending between the prongs; a backstop having a first backstop section at least partially defined by the cross-member and a second backstop section extending from the first backstop section at an acute angle relative to the prongs; and a mounting flange extending in a mounting flange plane perpendicular from and along the backstop and having a first mounting flange hole, a second mounting flange hole, and a third mounting flange hole, the method comprising:

with the mounting bracket attached to the wing plow in the first orientation with a first fastener installed in the first mounting flange hole and a second fastener installed in the second mounting flange hole, removing the first fastener from the first mounting flange hole and loosening the second fastener within the second mounting flange hole;

rotating the mounting bracket relative to the wing plow about the second fastener; and installing the first fastener within the third mounting flange hole to secure the mounting bracket to the wing plow in the second orientation.

* * * * *